United States Patent [19]

Lopata et al.

[11] 4,002,346

[45] Jan. 11, 1977

[54] ROLLER SEALING HEAD FOR OVERPRESSURE AND UNDERPRESSURE CONTAINERS

[75] Inventors: Karl Peter Lopata; Günter Schiffer, both of Krefeld, Germany

[73] Assignee: Kleinewefers Industrie Companie GmbH, Krefeld, Germany

[22] Filed: July 2, 1975

[21] Appl. No.: 592,782

[30] Foreign Application Priority Data

July 3, 1974 Germany ..... 2431900

[52] U.S. Cl. ..... 277/237 R; 68/5 E; 277/DIG. 7

[51] Int. Cl.[2] ..... B65D 53/00

[58] Field of Search ..... 277/237 R, DIG. 7; 68/5 E; 34/242

[56] References Cited

UNITED STATES PATENTS

| | | | |
|---|---|---|---|
| 3,048,992 | 8/1962 | Nakaguchi | 34/242 X |
| 3,255,616 | 6/1966 | Rust | 68/5 E |
| 3,807,059 | 4/1974 | Lopata | 277/DIG. 7 |
| 3,808,845 | 5/1974 | Lopata | 68/5 E |

*Primary Examiner*—Richard E. Aegerter
*Assistant Examiner*—L. Footland
*Attorney, Agent, or Firm*—Walter Becker

[57] ABSTRACT

A roller sealing head for overpressure and underpressure containers, especially for processing webs of textile and synthetic material with non-fixed application of print or dye or for non-treated webs of goods, in which a first sealing roller has a second sealing roller arranged opposite and in spaced relationship thereto while two endless sealing strips held in a rim-shaped frame are respectively associated with the first and second sealing rollers. The roller sealing head furthermore includes a hollow roller of a narrower width than that of the first and second sealing rollers. The arrangement is such that the web of goods to be processed is directly passed through between the hollow roller and one of the first and second rollers, while only one straight section of each endless sealing strip engages the inside of the hollow roller whereas the curved sections of the sealing strips as well as the second straight section of each sealing strip engages the sealing rollers. All of the rollers as well as the two rim-shaped frames and the two strips form with walls of the roller sealing head a chamber located ahead of the inlet or outlet opening of the pressure containers.

8 Claims, 3 Drawing Figures

ROLLER SEALING HEAD FOR OVERPRESSURE AND UNDERPRESSURE CONTAINERS

The present invention relates to a roller sealing head for use in connection with underpressure and overpressure containers, for instance, with a saturated steam atmosphere above one bar, especially for treating webs of textiles with non-fixed print or dye application or for untreated webs of goods with a sealing roll and an endless sealing strip held in a rim-like frame while between sections of said sealing strips, which sections are parallel to each other and to the axes of said rollers and between one of said sections and the roller, the web of goods is passed. More specifically, the invention relates to a roller sealing head of the above type in which the two sections which are parallel to the roller axis are interconnected by arched sections engaging the end sections of the roller. The sealer head may in a corresponding manner also be employed in connection with devices for treating other materials, for instance, webs of synthetic material.

Roller sealing heads are known which consist primarily of two axis parallel rollers between which there is passed the web of knit fabrics. With these roller sealing bodies difficulties exist with regard to the sealing at the end faces of the rollers. With roller-free sealing heads equipped with sliding means, this sealing problem can be mastered. However, these sealings are not suitable for sensitive goods such as knitted fabrics nor for such webs of goods which are provided with non-fixed print or dye, because due to the relative movement between the webs of goods and the sliding lip, the non-fixed print or dye application blurs or smears.

There has furthermore become known a roller-slide seal for gas or steam containers under overpressure for webs of goods which are to be treated continuously and which are provided with a drawing roller arranged in the direction of movement of the web of goods ahead of the container inlet or outlet opening, and furthermore equipped with a seal which cooperates with said drawing roller and engages the web of goods. For this seal reference is made to U.S. Pat. No. 3,808,845—Lopata issued May 7, 1974 referred to in U.S. Pat. No. 3,807,059—Lopata issued Apr. 30, 1974 and referred to in German patent disclosure that is the basis of claim for priority as to this present invention referring to German patent disclosure 2,142,926—Lopata dated Aug. 27, 1971. This seal consists of an endless sealing strip having sections which are parallel to each other and to the roller axis and are interconnected by arch-shaped sections which likewise engage the surface of the roller, while the sealing strips are self supporting or are held in a rim-like frame.

It is an object of the present invention to improve the above mentioned sealing device so that starting from the heretofore known roller-sliding sealing an exclusive roller sealing is provided with which a sealing at the end face of the rollers will be assured.

These objects and other objects and advantages of the invention will appear more clearly from the following specification, in connection with the accompanying drawing, in which.

Figure 1:
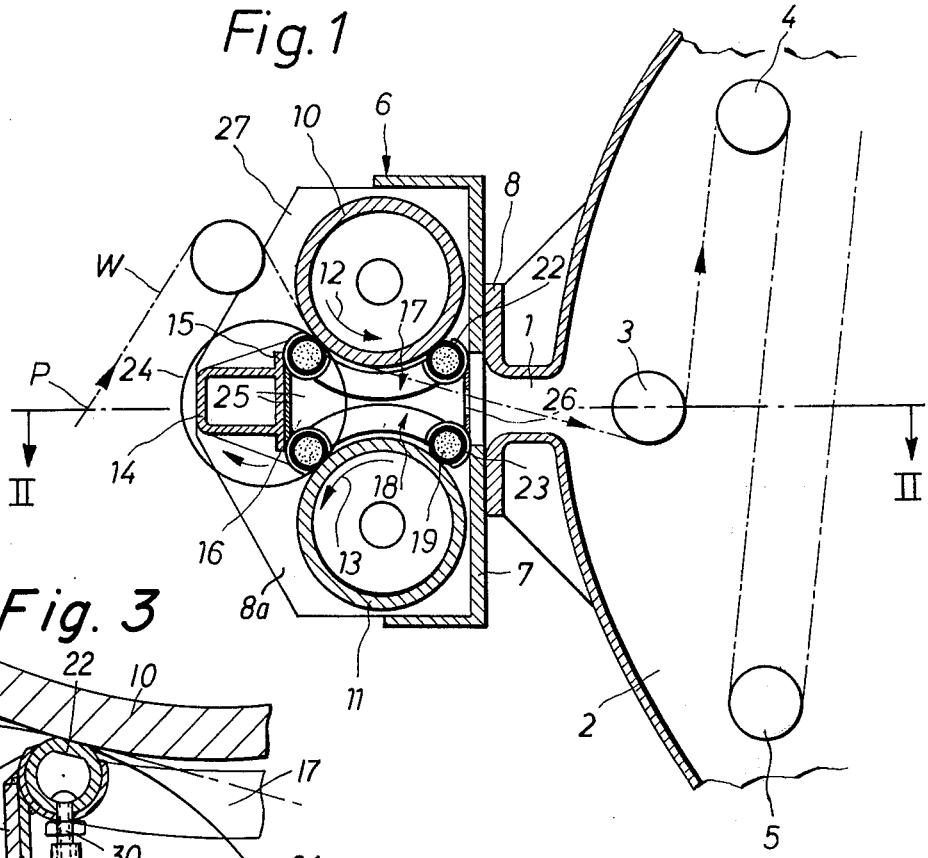
FIG. 1 is a vertical section through the seal according to the invention.
Figure 3:
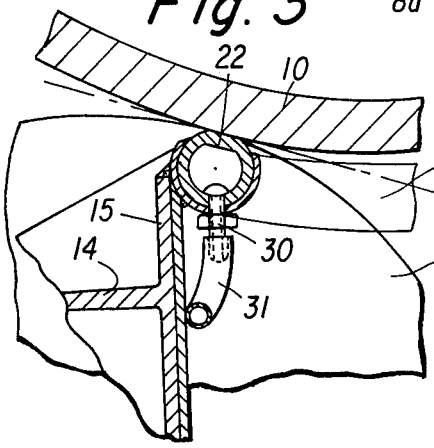
FIG. 3 represents a fragmentary sectioned view of an inflatable sealing strip means with valve means.

The roller sealing head according to the present invention is characterized primarily in that the one sealing roller has associated therewith in spaced relationship thereto a second sealing roller likewise equipped with an endless sealing strip and with a hollow roller of a narrower width than the width of the two sealing rollers while between the hollow roller of the narrower width and one sealing roller the web of goods is passed through directly and while one straight section of each endless sealing strip engages the inner side of the hollow roller, the roller as well as the two rim-like frames and the two strips with walls therebetween forming a chamber located ahead of the inlet or outlet opening of the pressure container.

The present invention is based on the idea, in contrast to heretofore known arrangements of the type involved, to place a straight section of each sealing strip onto the inner side of a hollow roller in order thereby to create the possibility of passing the web of goods without slip between said hollow roller and one of the two sealing rollers. To this end, the two sealing rollers may be driven synchronously while also the hollow roller may be driven.

According to further development of the invention, the hollow roller is passed through by a traverse which carries the two rim-like frames.

In order to be able to pass the endless sealing strips through the hollow roller, preferably the frame which carries the sealing rollers and the frame carrying the traverse may be divided into two parts so that also when dividing the rims and the wall sections provided between the rims, the parts which pass through the interior of the hollow roller can be introduced into said roller; preferably, the sealing rollers and the hollow roller are arranged in triangular shape on the inlet or outlet opening of the pressure container which is to be sealed. The sealing rollers are mounted in spaced relationship to each other in a vertical plane, and the hollow roller is arranged on that side which faces away from the inlet or outlet opening.

Referring now to the drawing in detail, a frame 6 for the roller sealing head is arranged in front of the inlet opening 1 of the pressure container 2 in which the reversing rollers 3, 4, 5 are located.

This frame 6 can have its wall portion 7 connected to the flange 8 of the container opening 1. In both side walls 8a of the frame 6 (only one being shown in the drawing) are mounted two sealing rollers 10, 11 which are located one above the other and which are driven synchronously in the direction of the arrows 12, 13.

Parallel to the two sealing rollers 10, 11 there is provided in frame 6 a U-shaped traverse 14 with a closure web 15. Between the wall section 7 and the said closure web 15, at the level of the opening 1 of the container 2 there is provided a pressure chamber 6, the edges of which are each provided with a rim 17, 18 which rims 17, 18 in a known manner are provided with two sections 19, 20 which are parallel to each other and parallel to the rollers 10, 11. The arch-shaped sections 21 are likewise parallel to the surface of the rollers 10, 11 in the same manner as the straight sections 19, 20 so that the sealing strips 22, 23 engage the surface of the rollers 10, 11 in a sealing or tight manner, said sealing strips 22, 23 being inserted into the endless rims.

Figure 2:
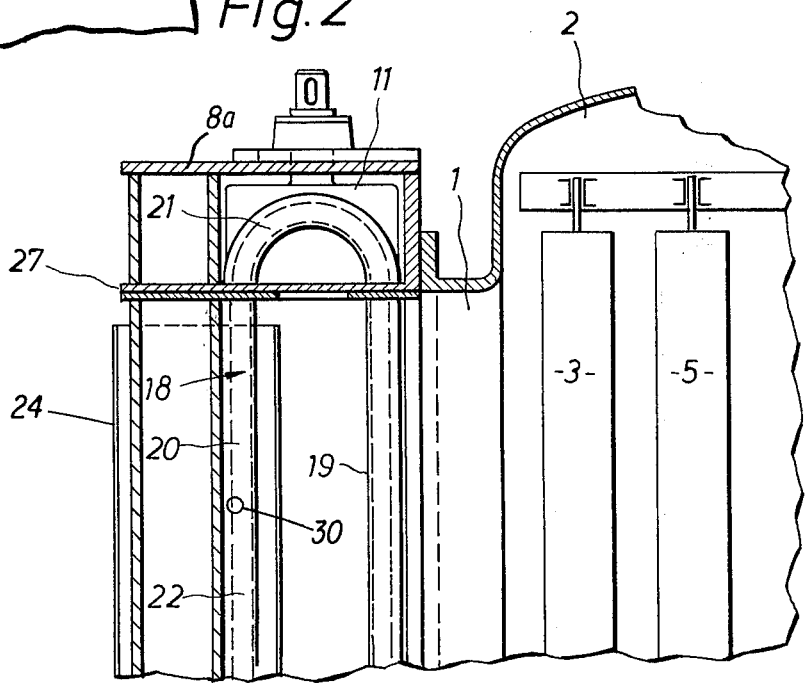
FIG. 2 represents a horizontal section through the seal according to the invention.

Around the one straight section 20 of the two superimposed rims as well as around the corresponding sealing strip sections there is provided a rotatable hollow roller 24 which surrounds said sections and the traverse 14 while between said hollow roller 24 and the sealing roller 10 the web W can be passed through in the direction of the arrow P. In this connection it is important that the hollow roller is shorter than the two sealing rollers 10, 11 so that, as will be seen from FIG. 2, only one straight section of both sealing strips 22, 23 engages the inside of the hollow roller 21, whereas the curved sections of the sealing strips 22, 23 as well as the second straight section engage the sealing rollers 10, 11.

The edges of the rims 17, 18 which receive the endless sealing strips 22, 23 are connected to the traverse 14 and the container 2 through the intervention of the closure web 15 or the wall section 7 of housing 6. An endless sealing strip 22 is shown at the lower left in FIG. 2; in FIG. 1 both endless sealing strips 22, 23 are shown. These endless sealing strips 22, 23 are formed by inflatable hollow bodies operable to be inflated independently of each other. The closure web 15 as well as the wall portion 7 may also form a portion of the pressure chamber between the rims. The pressure chamber 16 may additionally or exclusively comprise the walls 25 while an opening 26 is adjacent to the opening 1.

For purposes for facilitating the insertion into the passage of the rims and the sealing strip sections through the inner chamber of the hollow roller 24, the frame 6 may be subdivided. As will be evident from FIG. 2, also the frame may be divided at 27 while the corresponding sections of the device have the same division.

In this connection, it is of particular advantage to employ the seal according to the invention when the web W of goods as shown in FIG. 1, is introduced into the container between the hollow roller 24 and the sealing roller 10 and is treated in said container and then withdrawn between the hollow roller 24 and the sealing roller 13. To this end, there is provided the synchronously opposite movement of the roller 10, 11 and, as the case may be, the additional drive for the hollow roller 24.

It is, of course, to be understood that the present invention is, by no means, limited to the specific showing in the drawing, but also comprises any modifications within the scope of the appended claims.

What we claim is:

1. A roller sealing head for overpressure and underpressure containers, especially for use in the textile industry, which includes in combination: a housing, a first rotatable sealing roller supported by said housing, a second rotatable sealing roller supported by said housing and arranged in spaced relationship to said first sealing roller, a rotatable auxiliary roller formed by a hollow roller and supported by said housing while being located adjacent to both said first sealing roller and said second sealing roller, said auxiliary roller having a width less than that of said first and second sealing rollers, said auxiliary roller and one of said sealing rollers being operable to directly convey therebetween a web of goods to be processed, two endless sealing strips respectively associated with said first and second sealing rollers and each sealing strip having two oppositely located substantially straight sections and two curved sections respectively interconnecting the ends of said straight sections, only one of the straight sections of each endless sealing strip engaging the inside of said auxiliary roller while the curved sections of the sealing strips as well as the second straight sections of each sealing strip are operable to engage the respective adjacent sealing roller when no web of goods is passing therebetween and seal a web of goods when such web passes therebetween.

2. A roller sealing head in combination according to claim 1, in which said housing is provided with walls, and which includes frame means supporting said sealing strips.

3. A roller sealing head in combination according to claim 2, in which said two sealing strips together with walls of said roller sealing head form a chamber with an inlet and an outlet for the web of goods to be processed.

4. A roller sealing head in combination according to claim 1, which includes a traverse extending through said auxiliary roller and supporting said frame means.

5. A roller sealing head in combination according to claim 4, in which said housing includes sectional frame means supporting said sealing rollers and said traverse.

6. A roller sealing head in combination according to claim 1, in which said auxiliary roller and said sealing rollers have their axes arranged relative to each other so that the projection thereof defines the corners of a triangle.

7. A roller sealing head in combination according to claim 1, in which said two sealing rollers have substantially the same width.

8. A roller sealing head in combination according to claim 1, in which said endless sealing strips are formed by inflatable hollow bodies operable to be inflated independently of each other.

* * * * *